US008910645B2

(12) United States Patent
Piccioni

(10) Patent No.: US 8,910,645 B2
(45) Date of Patent: Dec. 16, 2014

(54) APPARATUS FOR CLEANING PAINT ROLLERS AND BRUSHES

(76) Inventor: Brian Joseph Piccioni, Campbellville (CA)

( * ) Notice: Subject to any disclaimer, the term of this patent is extended or adjusted under 35 U.S.C. 154(b) by 0 days.

(21) Appl. No.: 13/295,569

(22) Filed: Nov. 14, 2011

(65) Prior Publication Data

US 2012/0118333 A1 May 17, 2012

Related U.S. Application Data

(60) Provisional application No. 61/414,505, filed on Nov. 17, 2010.

(51) Int. Cl.

| | |
|---|---|
| ***A46B 17/06*** | (2006.01) |
| ***B08B 3/04*** | (2006.01) |
| ***B44D 3/00*** | (2006.01) |

(52) U.S. Cl.

CPC ..... *A46B 17/06* (2013.01); *B44D 3/006* (2013.01)

USPC ..... 134/149; 215/211; 215/212; 215/213; 215/214

(58) Field of Classification Search

CPC ..... A46B 17/06; B44D 3/006

USPC ..... 134/149

See application file for complete search history.

(56) References Cited

U.S. PATENT DOCUMENTS

| | | | | |
|---|---|---|---|---|
| 2,711,748 | A * | 6/1955 | Barsness | 134/149 |
| 2,884,709 | A | 5/1959 | Kruger | |
| 2,912,769 | A | 11/1959 | Kruger | |
| 3,733,645 | A | 5/1973 | Seiler | |
| 3,969,457 | A | 7/1976 | Paris | |
| 4,049,148 | A * | 9/1977 | Suhr et al. | 215/214 |
| 4,126,484 | A * | 11/1978 | Monteiro | 134/34 |
| 4,263,055 | A | 4/1981 | Permar | |
| 4,320,550 | A | 3/1982 | McGrew | |
| 4,332,067 | A | 6/1982 | Pearce | |
| 4,402,333 | A | 9/1983 | Frizzell | |
| 4,545,395 | A | 10/1985 | Kolb | |
| 4,606,777 | A | 8/1986 | Brow | |
| 4,708,152 | A | 11/1987 | Hibberd | |
| 4,711,258 | A * | 12/1987 | Rossborough et al. | 134/138 |
| 4,765,353 | A | 8/1988 | Rhoades | |
| 4,815,486 | A | 3/1989 | Schinn | |
| 5,005,598 | A | 4/1991 | Hodgdon | |

(Continued)

OTHER PUBLICATIONS

Fix-It Club, "Paint Rollers", only page, no date.*

*Primary Examiner* — Joseph L Perrin
*Assistant Examiner* — Levon J Shahinian
(74) *Attorney, Agent, or Firm* — Angela C. de Wilton

(57) ABSTRACT

An apparatus is provided for cleaning paint rollers and/or brushes. It comprises a roller cover/brush holder that may be coupled to a drill or other power tool, and a container and cap assembly. Advantageously, the container accommodates the holder and a roller cover or paintbrush with a minimal effective volume of cleanser. The cap closes and substantially seals the container to contain spray or spillage during high-speed rotation of the holder within the container. In use, the container is filled with cleanser, such as soapy water, and the roller is spun for several minutes. The container is drained, then refilled with rinse water and the process is repeated as needed. The roller or brush may be spun dry after cleaning, or between wash and rinse cycles. The apparatus provides effective cleaning with a reduced volume of water or cleanser and requires minimal clean-up.

20 Claims, 9 Drawing Sheets

(56) References Cited

U.S. PATENT DOCUMENTS

| | | | | | |
|---|---|---|---|---|---|
| 5,073,033 | A | * | 12/1991 | Klepeis | 366/343 |
| 5,163,459 | A | * | 11/1992 | Bailey | 134/182 |
| 5,185,938 | A | | 2/1993 | Hutt | |
| 5,409,027 | A | | 4/1995 | Glunt | |
| 5,539,948 | A | | 7/1996 | McCauley | |
| 5,937,534 | A | | 8/1999 | Anderson et al. | |
| 6,038,787 | A | | 3/2000 | Dean et al. | |
| 6,073,362 | A | | 6/2000 | Dean et al. | |
| 6,520,672 | B1 | | 2/2003 | Whitney | |
| 6,729,038 | B2 | | 5/2004 | Lonier | |
| 7,229,206 | B2 | | 6/2007 | Whitney | |
| 2002/0133967 | A1 | | 9/2002 | Lonier | |
| 2003/0079761 | A1 | * | 5/2003 | Rich | 134/25.3 |
| 2003/0233753 | A1 | | 12/2003 | Sala | |
| 2004/0151060 | A1 | | 8/2004 | Hutchinson | |
| 2005/0039785 | A1 | | 2/2005 | Knowles | |
| 2007/0169798 | A1 | | 7/2007 | Barr | |
| 2009/0293918 | A1 | | 12/2009 | Wikman | |

* cited by examiner

APPARATUS FOR CLEANING PAINT ROLLERS AND BRUSHES

CROSS-REFERENCE TO RELATED APPLICATION

This application claims priority from U.S. Provisional Patent Application No. 61/414,505, filed 17 Nov. 2010, entitled "Apparatus for Cleaning Paint Rollers and Brushes", which is incorporated herein by reference, in its entirety.

TECHNICAL FIELD

This invention relates to apparatus for cleaning paint applicators, such as paint rollers and paint brushes, and more particularly, to apparatus for cleaning paint rollers that may be coupled to an electric drill to spin the roller during cleaning.

BACKGROUND

Numerous prior art products are known for cleaning paint brushes and paint rollers. Although oil based or alkyd paints require volatile and often flammable solvents for clean-up, water-based paints are now widely available that allow for water clean-up using soap and water. Nevertheless, cleaning paint rollers thoroughly usually requires copious amounts of water, resulting in gallons of paint-contaminated water being washed down the drain. Many ingenious devices have been designed over the last 50 years or more for spinning the roller during cleaning, to make use of centrifugal force to remove paint and debris, and for spin drying the roller after cleaning. Typically, these devices are either hand-cranked or spun by coupling to an electric drill, while the roller is held in a bucket or container of soapy water for cleaning.

For example, one type of device, which is commercially available at hardware stores, is disclosed in U.S. Pat. No. 5,937,534, entitled "Paint Spinner". This tool uses a manually powered Yankee screwdriver mechanism, or other push/pull driven spinning mechanism (similar to the drive for a child's spinning top), to rotate a paint roller rapidly, e.g. at speeds of in excess of 800 rpm. Thus, the roller may be spun dry, e.g. after cleaning in running water from a hose, or in a bucket of water. Similarly, U.S. Pat. No. 5,185,938 provides an example of an attachment for a power drill for holding a paint brush or roller that may be spun at higher speeds for cleaning and spin drying, which results in more effective removal of paint. On the other hand, these and similar apparatus tend to be very messy to use, resulting in a lot of spray of paint and soiled water from spinning the wet roller, and they do nothing to reduce the amount of water required for cleaning. As a result of the spray, splash and mess, and also the difficulty in thoroughly cleaning rollers with a thick pile, many users simply treat the roller covers as disposable.

More complex apparatus is known which includes a container and a mechanism for spinning the roller, either by using a similar mechanical drive system, or by using a water powered spray to rotate the roller during cleaning, in a water-mill like fashion. By way of example, one such system is disclosed in U.S. Pat. No. 4,320,550 entitled "Paint roller cleaning apparatus", which uses a mechanical drive and an idler roller that is pressed against the paint roller to squeeze out paint during cleaning, and is then released to allow for the roller to be spun dry within the container. U.S. Pat. No. 4,402,333, entitled "Paint roller cleaning device", discloses a container with inlet and outlet ports for attaching to a water hose to direct a stream of water against the roller to spin it during cleaning. Another similar apparatus is disclosed in U.S. Pat. No. 5,409,027, entitled "Apparatuses for cleaning a paint roller through plural sprays which turn and clean supported rollers", which includes a large volume container for collecting the wash water or solvent.

These apparatus do collect the soiled water or solvent, and contain the spray, but still require large amounts of water or solvent, and the apparatus itself is complex and difficult to clean.

Numerous other devices are known, which provide paintbrush or roller cleaning attachments for an electric drill, e.g. U.S. Pat. No. 4,263,055, U.S. Pat. No. 4,332,067, U.S. Pat. No. 6,038,787, U.S. Pat. No. 6,520,672 B1, U.S. Pat. No. 6,902,315, U.S. Pat. No. 7,229,206 B2, US 2003/0233753, US 2004/0151060 A1, US 2005/0039785 A1, US 2009/0293918 A1, and U.S. Pat. No. 4,545,395.

Other types of devices for cleaning painting implements include, by way of example only: U.S. Pat. No. 3,733,645, U.S. Pat. No. 3,866,960, U.S. Pat. No. 4,606,777, U.S. Pat. No. 4,708,152, U.S. Pat. No. 4,765,353, U.S. Pat. No. 4,815,486, U.S. Pat. No. 5,005,598, U.S. Pat. No. 5,409,027, U.S. Pat. No. 5,539,948, U.S. Pat. No. 6,073,362, U.S. Pat. No. 6,729,038 B2, US 2002/0133967A1, US 2006/00004979A1, US 2007/0169798A1.

Compared with manually powered tools or apparatus, attachments that that can be coupled to an electric drill for higher-speed rotation, provide more effective cleaning. However, none of these known devices provide a satisfactory solution for reducing the volume of water or solvent required for cleaning, and those with containers to contain spray and collect wash water or solvent tend to be complicated, relatively expensive to manufacture, or use copious amounts of water or solvent.

Thus, there is a need for an improved apparatus for cleaning paint applicators, such as paint brushes and rollers, which addresses the shortcomings of known products.

SUMMARY OF INVENTION

The present invention seeks to reduce or overcome the limitations of these known products and methods, or at least provide an alternative.

Thus, according to one aspect of the present invention, there is provided an apparatus for cleaning paint rollers and/or paint brushes, comprising: a power tool attachment comprising a shaft having a first end for coupling to drive means of the power tool, and the other end providing a holder for holding a paint roller cover and/or a paintbrush; a container assembly comprising a tubular container and a cap, the tubular container having a closed end and an open end for receiving the holder of the drill attachment with a roller sleeve or paintbrush mounted on the holder, the cap having an opening for receiving the first end of the shaft allowing for axial alignment and high-speed rotation of the shaft within the container in use, means for securing the cap to substantially seal the open end of container; and the container having a length and diameter for accommodating the roller sleeve or a paintbrush mounted axially for rotation within the container, together with a volume of liquid comprising water, or other cleansing agent or rinse agent.

By providing a substantially sealed container assembly of limited volume, which provides for high-speed rotation of the roller cover/brush holder, the present inventor has discovered that a roller cover may be cleaned effectively using several cycles with a relatively small volume of cleanser or rinse agent. Thus, waste liquid may be collected for recycling or disposal. Use of copious amounts of cleanser or running water is avoided. The tubular container is preferably cylindrical and suitably sized to accommodate a roller cover of a particular size. To provide effective cleaning without using a large volume of cleanser, water or other solvent for washing and rinsing, the container preferably allows for a prescribed volume of liquid, which more preferably is a minimal volume of liquid (i.e. comprising cleanser or rinse agent), sufficient for effective cleaning in several cycles.

That is, the length of the container is typically 25% to 50% greater than the length of the longest roller cover which is to be cleaned, and the diameter is typically two to three times the diameter of the widest roller cover, or 50% greater than the widest brush, to be cleaned. A larger diameter results in excess use of solvent or water. In terms of diameter, it is important to have some distance from the roller cover to the wall of the container, but not too much, because this leads to wasted water or solvent. Unnecessary length increases cost and bulk. For example, for standard rollers, the container may have a length of 12 to 16 inches and a diameter of 4 to 6 inches. Thus, the container may be one to two inches greater in diameter than a standard 2 inch diameter, 9 or 10 inch long roller, and the fill volume of the container is preferably less than 2 to 3 liters (i.e. about 2 to 3 quarts).

The container may comprise a fill level indicator for the prescribed amount of liquid e.g. cleansing agent, rinsing agent, solvent, or water, as appropriate.

Other embodiments of the invention may call for different dimensions to suit various sizes of brushes or roller lengths and diameters. Nevertheless, preferably, the fill volume is as little as necessary to accommodate a minimal, yet effective, volume of liquid to allow the implement to be cleaned effectively with high-speed rotation and using a few wash, rinse and spin cycles. Even for cleaning larger brushes and roller covers, the fill volume of the container is preferably less than 10 liters, and more preferably less than 5 liters. This makes it both more economical and practical to use hot soapy water or solvent.

The roller/brush holder may comprise a hollow cylindrical portion extending from the shaft for holding a roller cover, together with a paint brush clamp, e.g. in the form of a pair of prongs for gripping a paint brush handle within the cylindrical portion, although other arrangements may be used.

Preferably, the shaft and holder of the drill attachment are held in axial alignment during rotation by the opening in the cap, or a bushing provided in the centre of the cap. The user may steady the cylinder by holding it if the need should arise. During typical use, the user would remove the drill from the shaft prior to operation, and when solvent or water is added to, or drained from the cylinder, which is accomplished by unscrewing the cap and pouring the water or solvent in to (or out of) the cylinder. It is not necessary to completely remove the cap in either case, therefore the soiled roller can be left in the cylinder, or, when emptying the solvent or water, the top cap retains the roller, shaft, and holder assembly and prevents the user's hand from being splashed with solvent, water, or paint.

The simple design allows for the container and cap to be molded from plastic or resin material, for example. The material should be rugged enough to ensure long life and resistant to hot water and commonly used paint solvents.

Advantageously, the cap or cover closes and substantially seals the container to prevent leakage or spillage. The securing means for securing the cap to the container may comprise a coarsely threaded coupling or a bayonet/twist lock or other "quick release" fastening. The cap may comprise an inner portion having a sidewall that extends into the open end of the container and engages an inner sidewall of the container, so that the cap thus forms a good seal against the rim of container and/or its inner sidewall. The inner portion of the cap may comprise strengthening ribs extending radially around the opening or bushing in the cap. Preferably the cap and container provide an effective seal without the need for a separate sealing element, such as an O-ring.

The container may optionally include a valve for draining the container, which may be at the top or bottom of the container, or part of the cap. The apparatus may include a handle and or a stand.

Beneficially, the apparatus itself is also easy to disassemble and clean, with minimal moving parts. The length of the drill attachment preferably fits within the container so it can be stored inside. The shaft is removable from the cap and not retained by it, to allow for cleaning. If required, a metal bushing may be provided in the cap to provide for free rotation and axial alignment of the shaft. However, if the material of the cap is thick enough and sufficiently wear-resistant, just a simple hole through the cap will do.

Another aspect of the invention provides a paint roller and brush cleaning kit, for example for cleaning painting implements of different sizes. For example, the kit may comprise an apparatus as described above for cleaning a roller cover or brush of a first size, and further comprises an additional container assembly and/or holder for cleaning a roller cover or brush of a second size, and/or may comprise separate holders for a roller cover and a paint brush.

A further aspect of the invention provides a method of cleaning a paint roller cover or paint brush using apparatus according to an embodiment of the invention, comprising: performing a sequence of wash, rinse and/or spin-dry cycles with a paint roller cover or a brush mounted on the holder of the drill attachment comprising: a) filling the container with a prescribed quantity of liquid comprising one of cleansing agent, rinse agent, solvent or water, closing the cap and substantially sealing the container, rotating the drill attachment at high-speed for several minutes; b) draining the liquid; c) re-sealing the container and spinning excess liquid from the roller cover or paintbrush, and repeating steps a), b) and c) as required.

Preferably, the method comprises: collecting liquid from each wash, rinse or spin-dry cycle for recycling or environmentally appropriate disposal.

The foregoing and other objects, features, aspects and advantages of the present invention will become more apparent from the following detailed description, taken in conjunction with the accompanying drawings, of preferred embodiments of the invention, which description is by way of example only.

BRIEF DESCRIPTION OF DRAWINGS

In the drawings, identical or corresponding elements in the different Figures have the same reference numeral.

DESCRIPTION OF PREFERRED EMBODIMENTS

Figure 1:
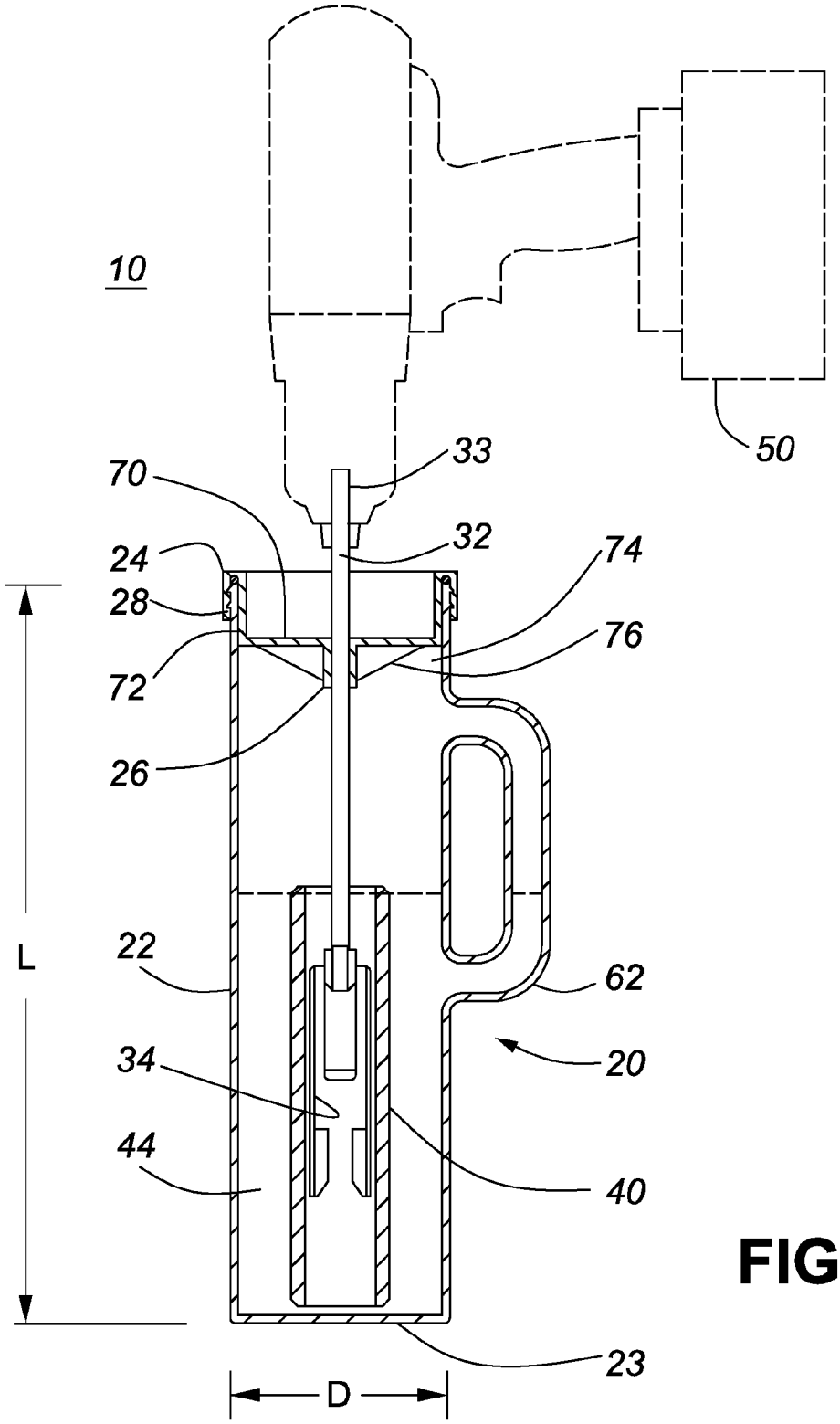
FIG. 1 shows a schematic cross-sectional view of an apparatus for cleaning paint rollers (i.e. roller covers) and paint brushes according to a first embodiment of the present invention.

An apparatus for cleaning paint rollers and paint brushes according to a first embodiment of the present invention is shown schematically in FIGS. 1 to 5. The apparatus 10 comprises an attachment 30 for a power tool, such as an electric drill 50. The attachment 30 comprises a shaft 32, e.g. a ¼ inch diameter steel rod, having at one end, a holder 34 in the form of a combined paint roller holder and paint brush clamp for holding a roller cover 40 or a brush 42 during cleaning. The other end of the shaft 33 is designed to be coupled to the power tool 50, i.e. clamped in the chuck of the drill, to enable the attachment 30 to be spun at high-speed during operation. The apparatus also comprises a container assembly 20, in the form of a tubular, e.g. cylindrical, container 22 and cap/cover 24. The container has a closed end at the base 23, and an open end 25 at the top for receiving the holder of the drill attachment with the paint roller cover or brush mounted on the holder. The container comprises a handle 62, which in this embodiment, is a hollow handle integrally molded with the container. The container 22 has a relatively low volume, and is sized to accommodate a paint roller cover of standard dimensions, together with sufficient volume of liquid 44, e.g. water or solvent, for proper operation.

The volume of the container assembly, relative to the size of the roller cover or brush to be cleaned, is selected to use a reduced or minimal effective volume of liquid, i.e. just sufficient cleanser, rinse agent such as water, or other solvent, for effective cleaning using several wash and rinse cycles. The dimensions of the container and the fill volume of the container relative to the size of the roller cover or paintbrush will be described in more detail below, together with a description of operation of the apparatus.

The cap or cover 24 has an opening or hole 26 through the centre to allow the shaft 32 of the drill attachment to pass through as shown in FIG. 1. The hole is of appropriate dimensions (i.e. diameter and thickness) to allow the shaft 32 to turn freely, while maintaining axial alignment of the shaft. The cap 24 securely closes and seals the rim of the open end 25 of the container 22, while providing for rotation and axial alignment of the shaft and holder during rotation within the container. To fasten the cap to the container, the container and cap preferably include a threaded fastening means 28, such as a twist lock, i.e. the cap is coarsely threaded, or otherwise provides a "quick release" fastening that fastens securely. The cap provides a sealing surface to seal the open end 25 of the cylindrical container in use.

Referring to the FIG. 1, it will be seen that in the preferred embodiment, the cap has an inner portion 70 with a sidewall 72 that extends into the container and fits closely against the inside the upper part 74 of the container 22, and the cap thus forms a good seal against the rim 25 of container and/or its inner sidewall 74. The inner part 70 of the cap has strengthening ribs 76 surrounding and along the length of the hole 26, for supporting and aligning the shaft 32 of the holder during use. The outer part of the cap has ribs 64 to allow the cap to be gripped firmly for opening and closing.

By providing a substantially sealed container assembly of limited volume, for operation using high-speed rotation of the roller cover/brush holder, e.g. around 1500 rpm, a roller cover may be cleaned effectively using several cycles with a relatively small volume of cleanser or rinse agent. To provide effective cleaning without using a large volume of cleanser, water or other solvent for washing and rinsing, the container preferably allows for a minimal volume of liquid (i.e. cleanser or rinse agent) for effective cleaning in several cycles. As illustrated in FIG. 1, for example, the container may be filled with liquid to a level sufficient to reach the top of the roller cover when it is inserted. Since the cap seals the container, the apparatus may be tilted somewhat during use (FIG. 2), to allow the top of the roller cover to be in contact with the liquid during spinning, even when the container is not entirely filled with liquid.

The tubular container is preferably cylindrical and suitably sized to accommodate a roller cover of a particular size. That is, as illustrated in FIG. 1, the length, L, of the container is typically 25% to 50% greater than the length of the longest roller cover which is to be cleaned, and the diameter, D, is typically two to three time the diameter of the widest roller cover, or 50% greater than the widest brush, to be cleaned. A larger diameter results in excess use of solvent or water. In terms of diameter, it is important to have some distance from the roller cover to the wall of the container, but not too much, because this leads to wasted water or solvent. Unnecessary length increases cost and bulk. For example, for standard rollers, the container may have a length of 12 to 16 inches and a diameter of 4 to 6 inches. Thus the container may be one to two inches greater in diameter than a standard 2 inch diameter, nine inch long roller, and the fill volume of the container is preferably less than 2 to 3 liters (i.e. about 2 to 3 quarts).

The simple design allows for the container and cap to be molded from plastic or resin material, for example. The materials would be rugged enough to ensure long life and resistant to hot water and commonly used paint solvents. If needed, a metal bushing in the opening in the cap may provide a durable bearing surface for alignment and rotation of the drill attachment shaft.

Figure 2:
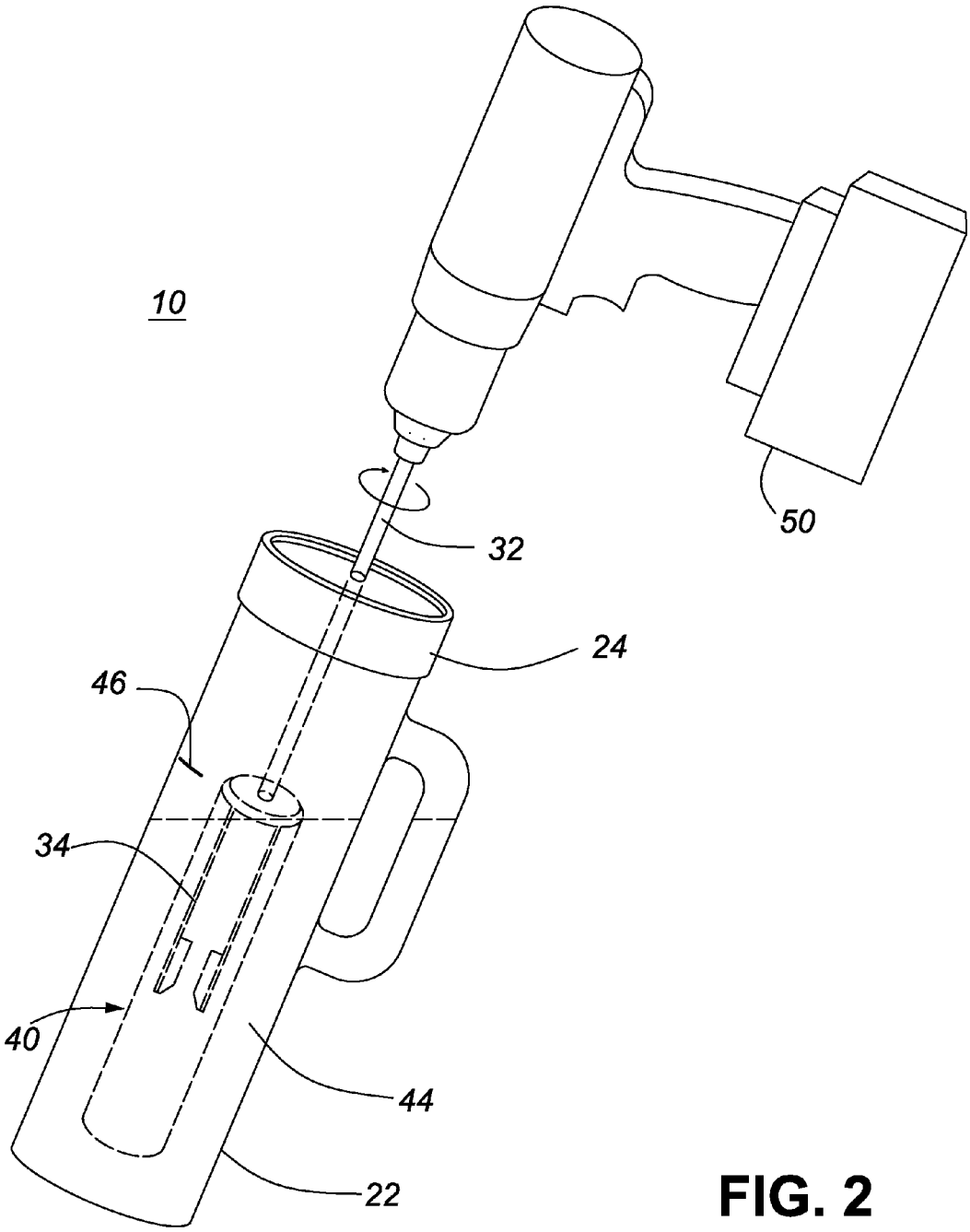
FIG. 2 shows a schematic perspective view of the apparatus illustrated in FIG. 1, coupled to a cordless electric drill for operation.

FIG. 2 shows a view of the apparatus of FIG. 1, attached to a battery-powered cordless drill 50 for operation, with a roller cover 40 mounted on the holder 34 of the drill attachment. The container 22 contains liquid 44, e.g. cleanser, such as water and detergent, or rinse agent, e.g. water or other solvent. In use, the container may be filled about ¾ full, or less, for example, with cleanser, and if required, during operation the apparatus may be tilted to ensure the top part of the roller cover contacts the liquid during high-speed rotation of the holder, as illustrated in FIG. 2, further reducing the volume of cleanser, rinse agent, e.g. water or solvent, that is required.

Figure 3A:
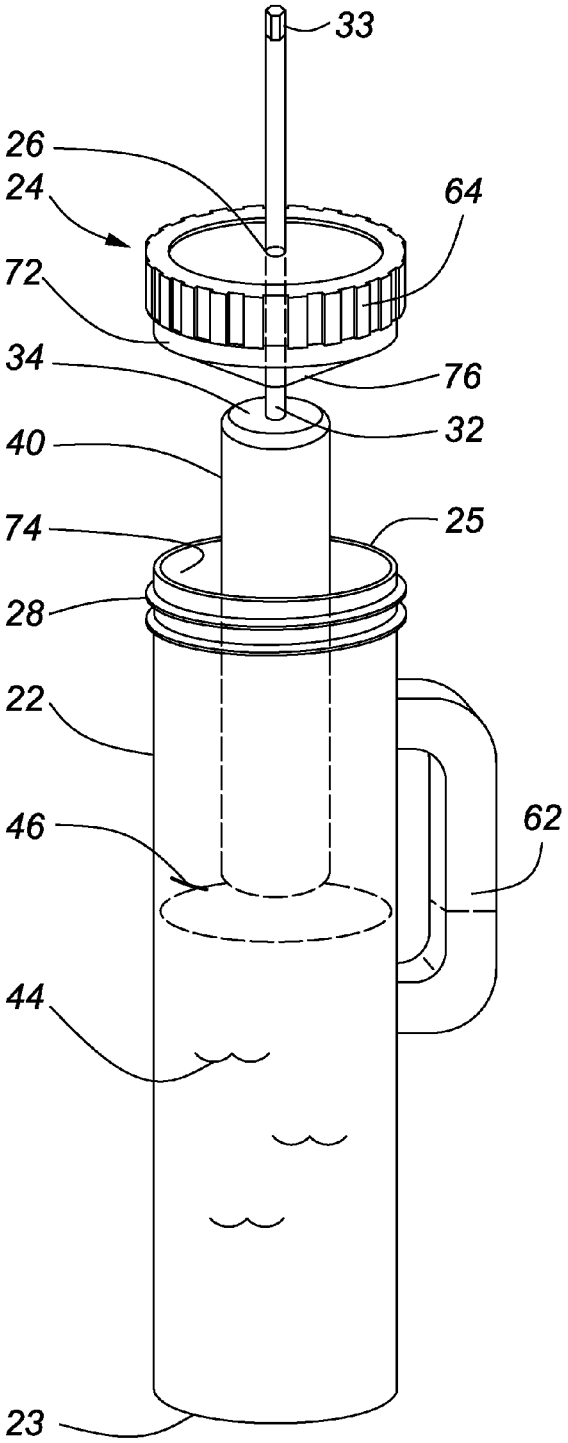
FIG. 3A shows a perspective view of the apparatus illustrated in FIG. 1, with the cap removed and the holder partially removed from the container.
Figure 3B:
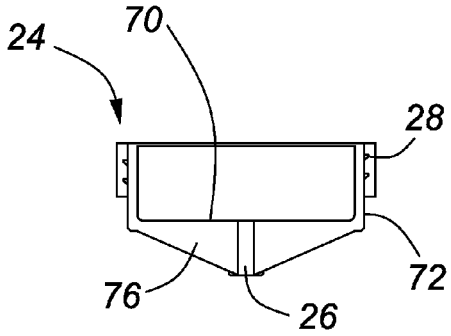
FIGS. 3B and 3C show, respectively, a cross-sectional view and a top view of the cap.
Figure 3C:
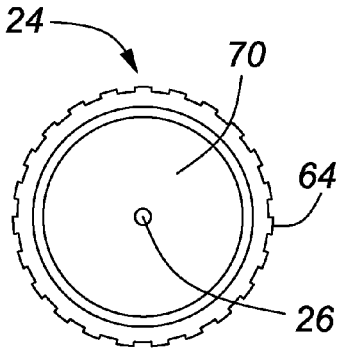

FIG. 3A shows a partially disassembled view of an apparatus similar to that shown in FIG. 1, with the cap removed, the drill attachment partially withdrawn from the container. FIGS. 3B and 3C shows further details of the cap. A fill line 46 indicates a suitable fill level for liquid, i.e. cleanser or rinse agent, to accommodate insertion of the holder with a roller cover for cleaning without overflow, and for effective cleaning.

Figure 4:
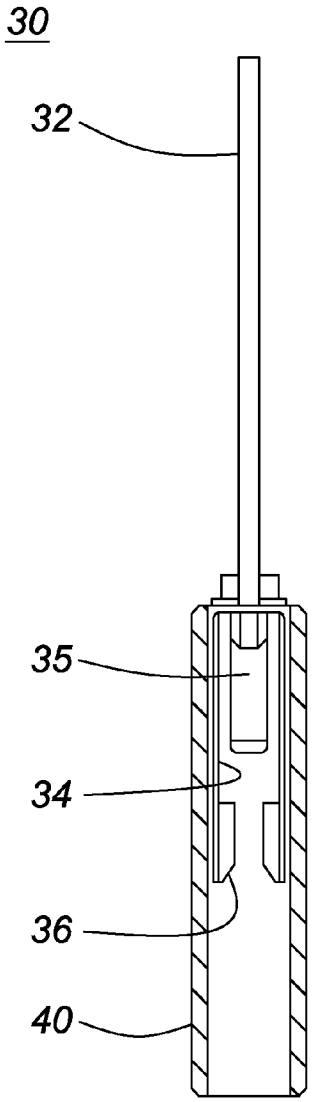
FIGS. 4 and 5, respectively, show side views of the attachment comprising the roller/paintbrush holder, illustrating how a roller cover and brush would be mounted on the holder.
Figure 5:
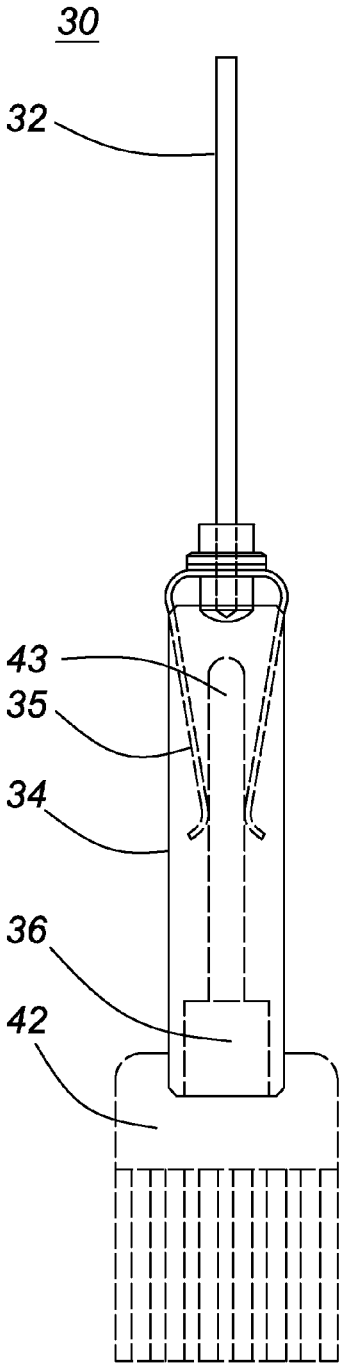

FIGS. 4 and 5 show two side views of the drill attachment 30, with the holder 34, which may comprise resiliently deformable elements 35, 36 e.g. made of spring steel, plastic, or other suitable material. The holder 34 has a suitable diameter so that a standard roller cover 40 can be slideably mounted on it in a conventional manner, and held in place by friction fit, as shown in FIG. 4. The holder 34 also acts as a paint brush clamp. The two pairs of resiliently deformable prongs 35, 36, within the roller holder 34, grip the handle 43 of the paintbrush 42 as illustrated in FIG. 5.

Figure 6:
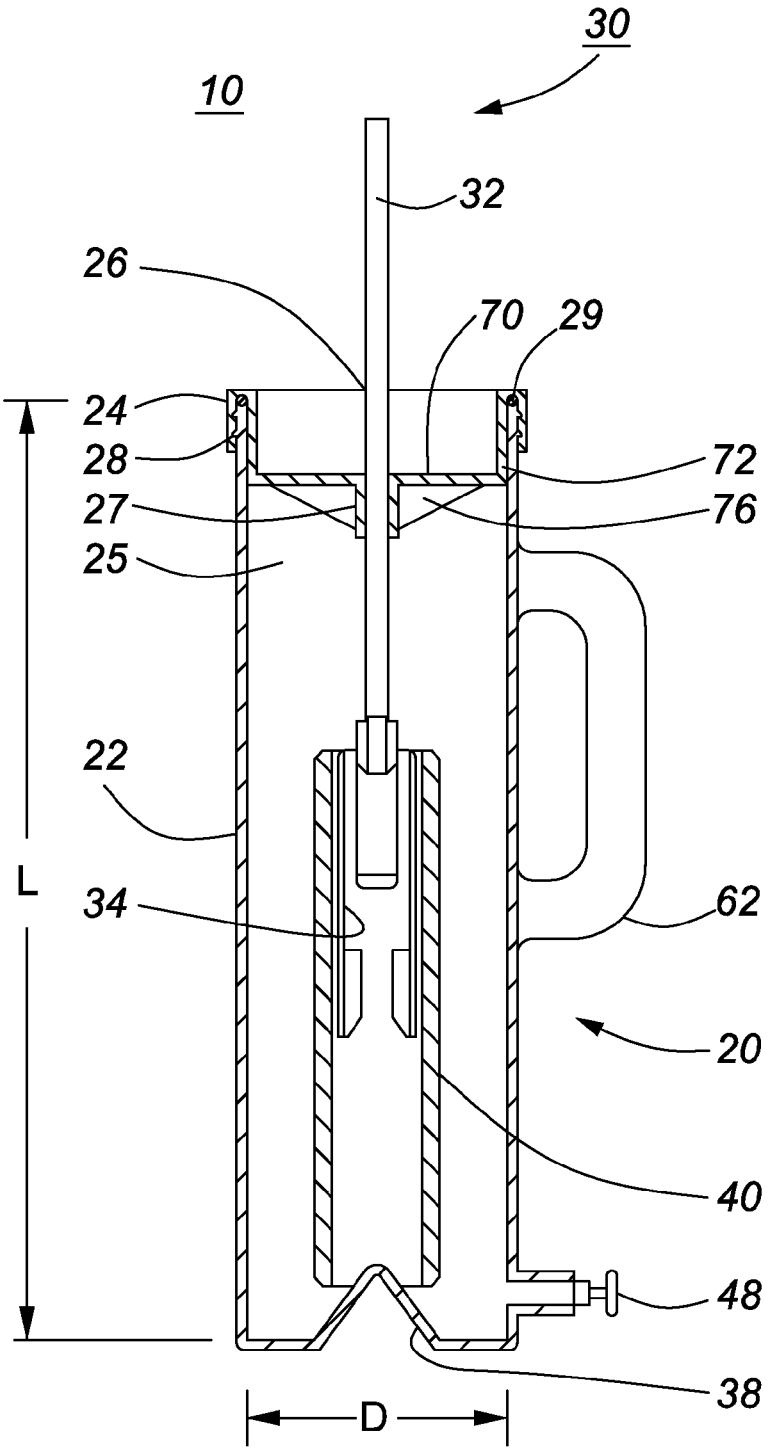
FIG. 6 shows a cross sectional view of an apparatus for cleaning paint rollers and brushes according to a second embodiment.
Figure 7A:
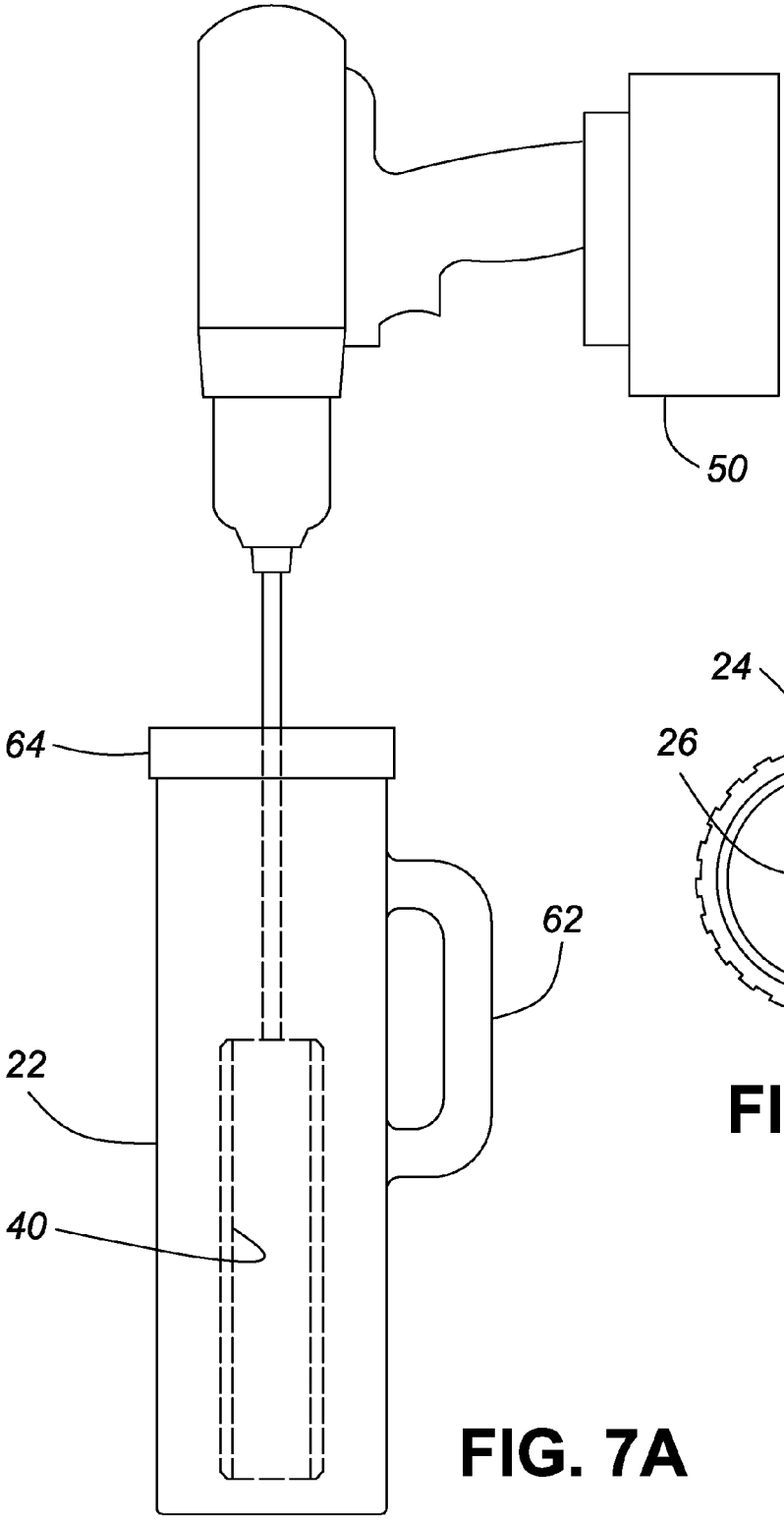
FIG. 7A shows a view of the apparatus of another embodiment, coupled to a cordless drill
Figure 7B:
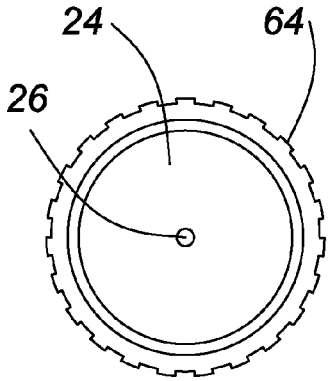
FIG. 7B shows details of the cap.

An apparatus according to a second embodiment is shown in FIG. 6. All parts are similar to those shown in FIG. 1, and similarly numbered, except that the container has a conical base 38, and optionally includes a valve 48, which in this example, is near the base of the container 22. Alternatively or additionally, (not shown) a valve may be provided near the top of the container, or in the cap to allow the container to be drained and/or filled without removing the cap. The convex conical base 38 further reduces the internal volume, assists in maintaining alignment of the roller cover during high-speed rotation, and may assist in collecting sediment or particulates. As mentioned above, an optional metal bushing 27 may be provided within the opening 26 of the cap 24, to provide a durable bearing surface for axial alignment and free rotation of the shaft 32. If required, a sealing element 29, such as an O-ring, is provided between the rim 25 at the open end of the container and the cap 24, i.e. carried by the container or cap, as illustrated in FIG. 6. FIG. 7A shows another embodiment, similar to that shown in FIG. 6, but without a valve, and coupled to a drill. FIG. 7B shows a view of the cap.

Figure 8:
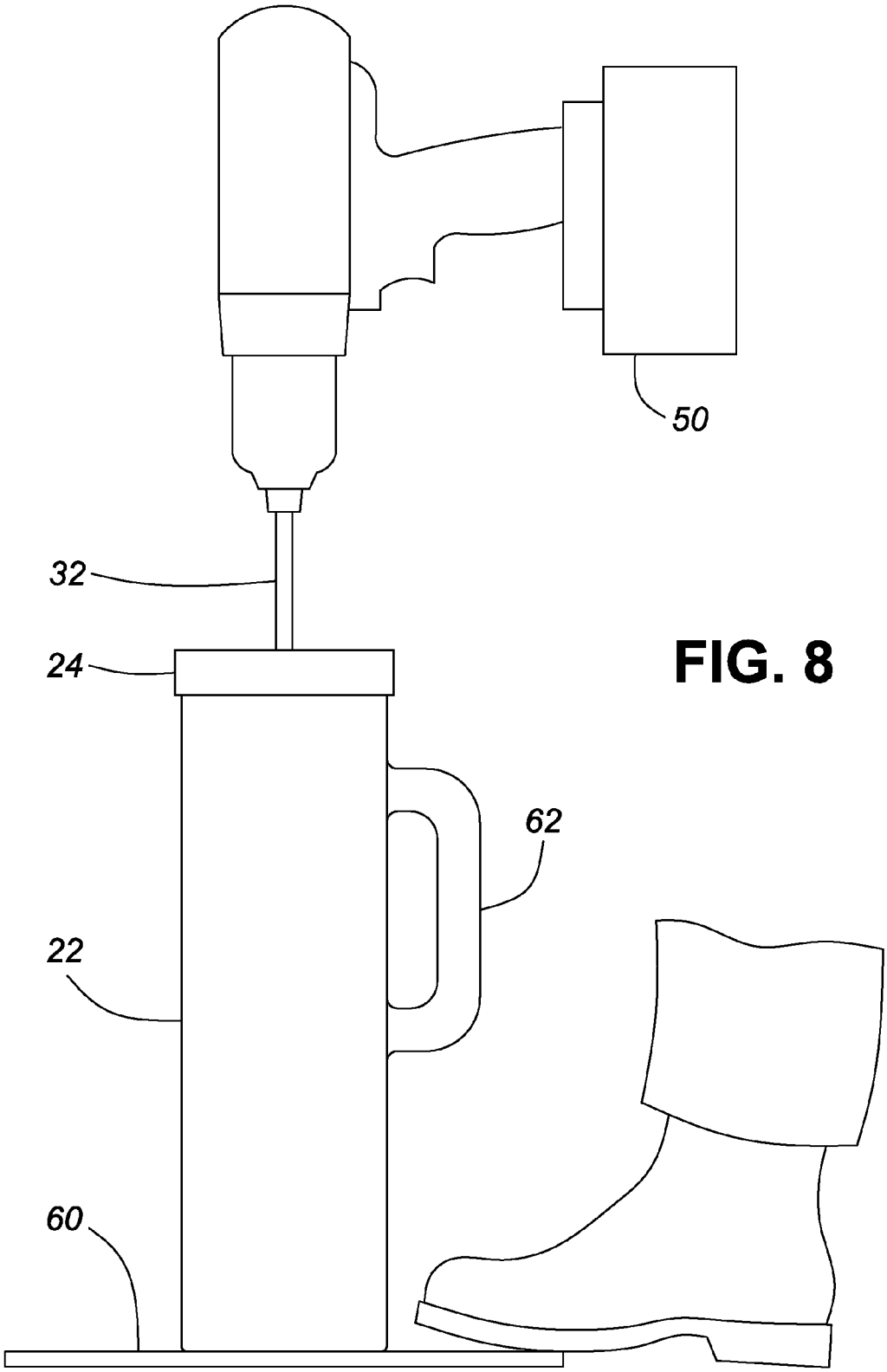
FIG. 8 shows an apparatus according to an embodiment comprising a stand.
Figure 9:
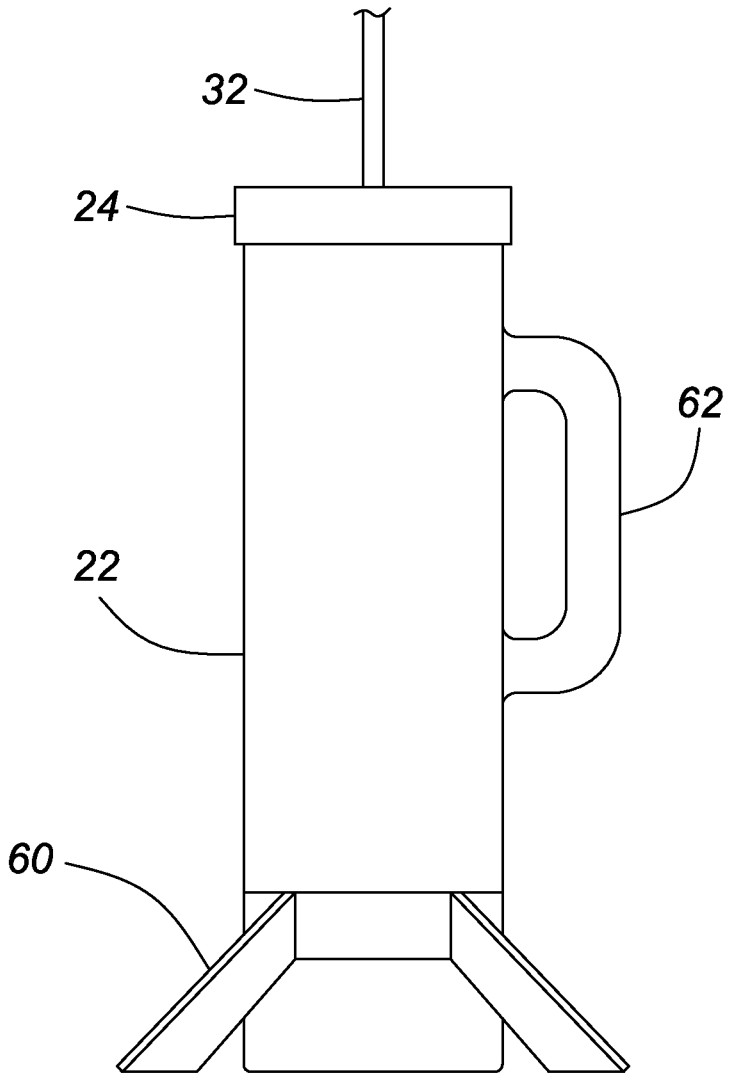
FIG. 9 shows an apparatus according to another embodiment comprising a stand.

The container may include a support or stand and/or a handle to steady the apparatus during operation, for example as shown in FIG. 8 or 9. The stand 60 may be of any suitable form, but an arrangement such as shown in FIG. 8, e.g. baseplate or two D shaped loops, allows the user to steady the apparatus during use, e.g. with the foot.

In use, a paint covered used roller cover 40, or brush 42, is mounted on the holder 34 of the drill attachment, the container is filled to the fill line 46, e.g. about ⅔ full with a suitable cleanser, e.g. hot water with soap or detergent or other solvent, or rinsing agent, e.g. water or other solvent. The drill attachment holding the dirty roller or brush is inserted into the tube, the cap is screwed on and the other end of the shaft 33 is clamped in the chuck of the drill. The drill is run at high-speed, e.g. 1500 rpm, for 1 to 2 minutes to centrifugally remove the paint or debris and clean the roller or brush. The container is then opened and emptied of liquid by removing the cap. The container is refilled with cleanser or rinsing agent and the process is repeated as necessary to thoroughly clean the roller. After draining the container, the cleaned roller may then be spun dry. The roller may also be spun to remove excess cleanser or water after each wash or rinse cycle. The container provides a substantially sealed tube so there is much less mess, and splashes and spray are contained during use.

During typical use, the user would remove the drill from the shaft prior to operation, and when solvent or water is added to, or drained from, the cylinder, which is accomplished by unscrewing the cap and pouring the water or solvent in to (or out of) the cylinder. It is not necessary to completely remove the cap in either case, e.g. the cap may be raised a couple of inches to fill and empty the container, therefore the soiled roller can be left in the cylinder, or, when emptying the solvent or water, the top cap retains the roller, shaft, and holder assembly and prevents the user's hand from being splashed with solvent, water, or paint.

If, as shown in FIG. 6, for example, the container assembly 20 includes a valve 48, the latter may be used for filling or emptying the container without removing the cap.

The container assembly is sized to allow for effective cleaning with a prescribed volume of liquid, i.e. comprising cleanser, rinse agent, solvent, water, or other cleaning mixture, using a sequence of wash rinse and spin-dry cycles. The prescribed volume may be indicated by a fill level indicator or in the instructions.

Preferably, for a standard sized roller, the diameter of the container is sized to provide a fill volume of only a few liters. The fill volume, or prescribed volume, is preferably as little as necessary to allow the painting implement to be cleansed, e.g. using a few wash, rinse and dry cycles. Thus it is practical to use hot water, or solvent for cleaning. Ideally, container diameter is not more than an inch or two greater in diameter than a typical standard paint roller, for example. Although a relatively small volume of cleanser or water is required for each cycle, high-speed rotation results in effective cleaning of the roller using much less solvent or water than conventional known products. Also, the low volume makes it more economical to use hot water or solvent for cleaning. The soiled water can be collected in a second/waste container and may be allowed to evaporate, rather than washed down the drain. The dried paint residue can then be disposed of appropriately in a more environmentally favourable way.

By way of example, for a range of standard roller covers, the container may be about 4.5 inches in diameter, and 12 to 16 inches high. A typical volume of cleanser or rinse agent for cleaning roller covers of various lengths in a 4.5 inch diameter container is shown in Table 1. It is possible use about 80% of these amounts if the device it tilted during use.

| Roller Length | Volume |
|---|---|
| 3" | 1.0 liter |
| 4" | 1.4 liter |
| 7" | 2.4 liter |
| 9" | 3.1 liter |
| 14" | 4.9 liter |
| 18" | 6.3 liter |

The apparatus described above is also simple and inexpensive to manufacture. For example the container assembly may be molded from a suitable plastic/resin, i.e. one that is resistant to paints, hot water and commonly used paint solvents, and is preferably rugged enough for extended use. For example, the container may be made of polyethylene.

The apparatus results in more effective cleaning, less mess and can be operated with much less solvent or water than other systems. It avoids the use of copious amounts of running water, and generation of large volumes of soiled, paint contaminated water, which are not readily disposed of in an environmentally friendly manner. These advantages, and the relative ease of use, encourage the cleaning and reuse of rollers and brushes that may otherwise be discarded.

The apparatus according to preferred embodiments is intended for use as an attachment for a power tool, such as, an electric drill. Since the apparatus uses a relatively small volume of cleanser or rinse agent, sustained, high-speed rotation, at least 100 rpm and preferably from several hundred rpm to 1500 rpm, i.e. by coupling of the attachment to an electric drill or other suitable power tool, is needed for effective cleaning with small amounts of liquid. A conventional hand-cranked mechanism is unlikely to provide sufficient rotation speed for effective cleaning with a small volume of cleanser.

The user may steady the cylinder by holding it during operation of the drill to spin the roller (or brush). Thus apparatus may include a handle 62 and/or a stand 60 (e.g. see FIGS. 8 and 9) to make it easier to stabilize during use. The outside surface 64 of the cap 24 may be textured, ribbed or fluted (e.g. see FIG. 3C or 7B) to provide a gripping surface to facilitate opening and closing.

Embodiments of the apparatus, including a roller and brush holder 34 as described above conveniently accommodate rollers covers of a standard diameter (about 1.5 inch inside diameter, or so, plus the thickness of the pile) and smaller paintbrushes of a similar width. An even smaller volume of water or solvent may be used for cleaning of paintbrushes, since the container would need to be filled only to cover bristles of the brush. Since the shaft 32 of the holder can slide within the opening or bushing in the cap, in use, the holder can be inserted further into the container to accommodate roller covers of shorter lengths or to ensure a smaller roller cover or brush is adequately immersed in liquid. The roller brush holder 34/36 provides a simple design which is readily manufactured, and conveniently may be of a suitable length to be stored within the container assembly when not in use. However, in alternative embodiments, other suitable roller cover/brush holder designs may be used.

Another embodiment of the invention provides a kit comprising a paint roller apparatus as described above for cleaning standard roller covers, and further comprising an additional roller cover/brush holder and/or container assembly, e.g. for cleaning small brushes and rollers of other sizes. Separate roller holders and brush holders may be provided. In particular, a second drill attachment or an adapter with a holder sized, e.g. for small foam rollers, together with a smaller sized container and cap, would allow for efficient cleaning of smaller applicators which are typically used for trim or edging (cutting-in). In yet another embodiment, a larger size apparatus is provided with a container assembly that can accommodate a "magnum" roller cover, e.g. 24 inches in length and of larger diameter. However, in each case, the container is sized to be of an appropriate length, and preferably not more than 1" or 2" more in diameter than the particular size of the roller cover to be cleaned, i.e. to contain a minimal amount of solvent or cleanser for an effective cleaning cycle.

Figure 10:
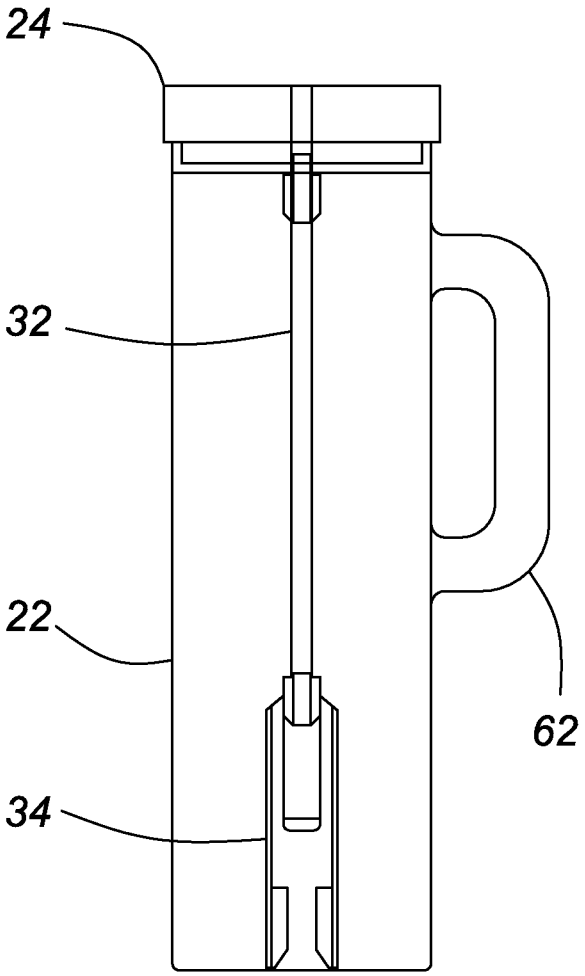
FIG. 10 shows another view of the apparatus of FIG. 1, illustrating how the holder attachment fits inside the container assembly for storage.

For convenient storage of the apparatus, the drill/power tool attachment (i.e. shaft and roller/brush holder) has a suitable length that it can be accommodated within the container for storage, as shown in FIG. 10. The cross-section of the end 33 of the shaft may be hexagonal, for example, or otherwise suitably shaped, to reduce slipping in the drill chuck during rotation. The apparatus may be disassembled for easy cleaning, i.e. the drill attachment 30 is removable from the cap 24. Preferably the cap 24 and the container have inner surfaces that are easily cleaned and do not trap paint residue, and preferably they provide an effective seal without the need for a separate sealing element such as an O-ring.

The drill attachment may comprise a shaft with a quick connect/disconnect coupling to enable the drill to be readily connected and disconnected from the assembly during use, e.g. during filling or emptying of the container.

Preferably the apparatus is driven with a power tool, such as a battery operated power drill or an impact tool capable of rotating the attachment at a suitable speed for effective cleaning. In alternative embodiments (not illustrated), the apparatus may include an integral or built-in drive unit 50, such as a small electric motor, coupled to the drive attachment, to provide a self-contained power tool.

It will be appreciated that apparatus according to embodiments of the invention are primarily intended for use with water-based paints, e.g. latex and acrylic, which may be cleaned with water or other non-flammable cleansers or solvents. For safety reasons, the apparatus is not intended to be used for cleaning oil based paints, or for use with and toxic or flammable solvents or cleansers, although such use would work in exactly the same manner as with water or non-flammable cleaners. Suitable safety precautions would be required.

Although embodiments of the invention have been described and illustrated in detail, it is to be clearly understood that the same is by way of illustration and example only and not to be taken by way of limitation, the scope of the present invention being limited only by the appended claims.

The invention claimed is:

1. An apparatus for cleaning a paint roller cover, comprising:

a power tool attachment comprising a paint roller cover holder, the holder extending axially on a shaft having a first end for coupling to drive means of a power tool for high speed rotation of the holder;

a container assembly comprising a tubular container and a removable cap, the tubular container having a sidewall, a closed end at its base, and an open end for receiving the holder of the power tool attachment with a roller cover mounted on the holder, the cap being of unitary construction and comprising a first inner portion that extends into the open end of the container and engages an inner part of the sidewall of the container, and a second inner portion of the cap defining a cylindrical opening through a center of the cap receiving the shaft in axial alignment within the container, a quick release fastening removably securing the cap to the container in sealing engagement with the open end of the container, the second inner portion of the cap having a thickness in an axial direction greater than the diameter of the cylindrical opening and comprising radial and axial strengthening around the cylindrical opening to provide a bearing surface for rotation of the shaft within the cylindrical opening, the bearing surface providing lateral stability maintaining the shaft and roller holder in axial alignment relative to the sidewall of the container assembly during high speed rotation of the power tool attachment; and the container having a length and diameter accommodating the holder for rotation within the container, with clearance between the holder and the sidewall of the container for a roller cover mounted on the holder together with a surrounding volume for liquid comprising water or other cleansing agent or rinse agent.

2. An apparatus according to claim 1 for cleaning a roller cover of diameter d, wherein the diameter of the container is not more than three times the diameter of the roller cover.

3. An apparatus according to claim 2 wherein the diameter of the container is not more than two inches greater than the diameter of the roller cover.

4. An apparatus according to claim 2 wherein the diameter of the container is not more than one inch greater than the diameter of the roller cover.

5. An apparatus according to claim 1, wherein the container has a fill volume of less than 5 liters.

6. An apparatus according to claim 1 for cleaning a standard roller cover, and wherein the container has a fill volume of 2 to 3 liters.

7. An apparatus according to claim 1 wherein said volume of liquid comprises a prescribed volume of liquid, comprising one of cleansing agent, rinse agent, solvent, and water, sufficient for effective cleaning using several cycles.

8. An apparatus according to claim 1 wherein the container comprises a fill level indicator for a prescribed amount of liquid, comprising one of cleansing agent, rinse agent, solvent, and water, sufficient for effective cleaning using several cycles.

9. An apparatus according to claim 1 wherein the quick release fastening removably securing the cap to the container comprises a coarsely threaded screw coupling or a bayonet coupling or other twist lock fastening.

10. An apparatus according to claim 1 wherein the container and cap are fabricated from a molded plastic/resin material.

11. An apparatus according to claim 1 wherein an exterior surface of the first and second inner portions of the cap forms an outer recess around the cylindrical opening in the cap.

12. An apparatus according to claim 1 wherein the radial and axial strengthening around the cylindrical opening comprises strengthening ribs extending radially around the cylindrical opening in the cap.

13. An apparatus according to claim 1 wherein an exterior surface of the cap comprises an outer recess around the cylindrical opening, and wherein the power tool attachment has a length approximately equal to the length of the container assembly, and wherein, in a retracted position for storage, the attachment is held in axial alignment within the container assembly the first end of the shaft extending through the cylindrical opening into the outer recess and without the first end protruding beyond the length of the container assembly.

14. An apparatus according to claim 1 wherein the holder further comprises a paintbrush holder.

15. An apparatus according to claim 14 wherein the holder comprises a cylindrical portion extending from the shaft for holding a roller cover and a clamp means for holding a paint brush handle within the cylindrical portion.

16. An apparatus according to claim 1 wherein the container assembly further comprises: a valve for draining and/or filling the container, and/or a sealing element disposed between the open end of the container and the cap.

17. An apparatus according to claim 1 wherein the container assembly further comprises: a handle and/or a stand.

18. An apparatus according to claim 1 wherein the bearing surface of the opening in the cap comprises a bushing for removably receiving the shaft in axial alignment with the cap and container.

19. A paint roller/brush cleaning kit comprising the apparatus of claim 1 for cleaning a roller cover or brush of a first size, and further comprising an additional container assembly and/or holder for cleaning a roller cover or brush of a second size, and/or separate holders for a roller cover and a brush.

20. A paint roller cover cleaning apparatus, comprising:

an attachment comprising a paint roller cover holder extending axially on a shaft having a first end for coupling to drive means of a power tool for high speed rotation of the holder;

a container assembly comprising a tubular container and a removable cap, the tubular container having a sidewall, a closed end at its base, and an open end capable of receiving the holder of the attachment with a roller cover mounted on the holder, the container having a length and diameter providing clearance between the holder and the sidewall for accommodating the roller cover and a surrounding volume of liquid, the cap being of unitary construction and comprising a first inner portion that extends into the open end of the container and sealingly engages an inner part of the sidewall of the container, and a second inner portion of the cap defining a cylindrical opening through a center of the cap, receiving the shaft of the attachment therethrough, in axial alignment within the container, a quick release fastening removably securing the cap in sealing engagement with the open end of the container, the container comprising holding means for steadying and tilting the container assembly, and the second inner portion of the cap having a thickness in an axial direction greater than a diameter of the cylindrical opening and comprising radial and axial strengthening around the cylindrical opening to provide a bearing surface for rotation of the shaft within the cylindrical opening, the bearing surface providing lateral stability maintaining the shaft and roller holder in axial alignment relative to the sidewall of the container assembly during high speed rotation of the attachment and when the container assembly is tilted.

* * * * *